US006994345B2

(12) United States Patent
Henry

(10) Patent No.: US 6,994,345 B2
(45) Date of Patent: Feb. 7, 2006

(54) CARD GAME

(76) Inventor: Keith M. Henry, 22193 Ulster, Detroit, MI (US) 48219

( * ) Notice: Subject to any disclaimer, the term of this patent is extended or adjusted under 35 U.S.C. 154(b) by 329 days.

(21) Appl. No.: 10/640,669

(22) Filed: Aug. 14, 2003

(65) Prior Publication Data

US 2005/0035547 A1 Feb. 17, 2005

(51) Int. Cl.
*A63F 1/00* (2006.01)

(52) U.S. Cl. ..... 273/274; 273/292

(58) Field of Classification Search ..... 273/274, 273/292, 309; 463/12, 13
See application file for complete search history.

(56) References Cited

U.S. PATENT DOCUMENTS

| | | | | |
|---|---|---|---|---|
| 4,795,161 | A | 1/1989 | Chao | |
| 5,072,946 | A | 12/1991 | Miller | |
| 5,431,407 | A * | 7/1995 | Hofberg et al. | 273/292 |
| 5,566,946 | A | 10/1996 | Parker | |
| 5,813,673 | A * | 9/1998 | Richardson | 273/292 |
| 5,816,577 | A | 10/1998 | Preston et al. | |
| 5,839,731 | A | 11/1998 | Feola | |
| 5,895,047 | A | 4/1999 | Callahan | |
| 6,004,205 | A | 12/1999 | Lauretta et al. | |
| 6,102,403 | A * | 8/2000 | Kaufman | 273/292 |
| 6,164,652 | A | 12/2000 | Lauretta et al. | |
| 6,234,483 | B1 | 5/2001 | Bucan | |
| 6,382,629 | B1 | 5/2002 | Hill | |
| 6,402,149 | B1 | 6/2002 | Chou | |
| 6,702,290 | B2 * | 3/2004 | Buono-Correa et al. | 273/292 |
| 2002/0036381 | A1 * | 3/2002 | Scibetta | 273/292 |

* cited by examiner

*Primary Examiner*—William M. Pierce
(74) *Attorney, Agent, or Firm*—Richard C. Litman

(57) ABSTRACT

The card game is played using two decks of cards per each hand, with the dealer dealing out two groups of cards face down from one deck and a single face up reference card from the second deck. The dealer then turns up each of the cards sequentially from the two groups of the first deck, with the object being to attain an exact match between any or the cards of the two groups, and the reference card. Optionally, players may wager upon the likelihood of the occurrence of a specific mismatch.

14 Claims, 2 Drawing Sheets

CARD GAME

BACKGROUND OF THE INVENTION

1. Field of the Invention

The present invention relates to gambling or wagering games, and more specifically to a card game adapted particularly for casino play or the like. The present game uses two decks of standard playing cards, with players wagering upon the likelihood of a single card matching or being a specific mismatch to any of the cards of two series of cards dealt by the dealer.

2. Description of the Related Art

Innumerable games and pastimes have been developed in the past to fill the need for entertainment and relaxation for people. A large percentage of these various games and activities have been developed to provide for wagers to be placed upon the outcome, particularly in the case of various card games which have been developed over the years.

Most such games are relatively simple, with relatively few rules. This is generally desirable, as it requires less mental effort on the part of the players and also permits the game to proceed at a faster pace, which results in more wagers for the casino or facility operating the game. Examples of such games are blackjack (twenty one), baccarat, and various forms of poker.

Most such games are comparative, i.e., the suits or values of various hands (dealer, player or players, etc.) are considered against one another, or against some predetermined maximum or minimum value. Poker adds to this by providing a series of different combinations of cards having different ranks relative to one another. As such games have become reasonably well known among those who enjoy such activities, there will occasionally be an attempt to add some further rule or rules to such games, in an effort to increase interest in a well-known game and/or to avoid boredom among players. However, such efforts almost always end up complicating the game to the point that novice players shy away from the game, and experienced players may not wish to play due to the changes in the previously familiar rules and format.

Another problem with many wagering card games is that players have only one chance to win in any given hand or round of play. While some players may believe that the payout odds are sufficient to make it worthwhile to place a wager with only one chance of winning per hand, other players may tend to avoid such games in the belief that they have a lesser chance of recovering their wagers. As a result, a number of classic wagering card games, e.g. blackjack and poker, have been modified with the addition of further provisions allowing for the possibility of multiple wagers, and corresponding wins or losses, with each hand or round of play. Of course, this tends to complicate the game, leading to the problems of avoidance by newer players and lack of familiarity by more experienced players, as noted above.

Accordingly, a need will be seen for a wagering card game which provides a relatively simple and straightforward set of rules, yet which allows players to place multiple wagers upon the outcome of a single hand or round of play, if so desired. The present game responds to this need by providing a wagering game in which a dealer deals two sets or groups of cards from a single deck, and then deals a single reference or "pull" card from a second deck. Players may place wagers upon the likelihood of the pull card matching one of the cards in the first set, or optionally in the second set. Further wagering options allow players to wager upon the likelihood of a specific mismatch to the single card appearing in either the first or second set, i.e., a card having the same value or rank and suit color, but of a different suit, e.g. spades and clubs or hearts and diamonds. Different payouts are provided for different wagers, depending upon the progression of the hand during play.

A discussion of the related art of which the present inventor is aware, and its differences and distinctions from the present card game invention, is provided below.

U.S. Pat. No. 4,795,161 issued on Jan. 3, 1989 to Dwight W. Chao, titled "Card Game," describes a series of numbered cards which may be used as chance means for selecting numbers for play in a lottery game or the like. Some of the cards allow the user to enter one or more preferred numbers thereon. As such, the Chao cards are not strictly a game, but rather allow a person to use the cards for selecting numbers for play in another game.

U.S. Pat. No. 5,072,946 issued on Dec. 17, 1991 to Mark M. Miller, titled "Method Of Playing A Wagering Casino-Type Card Game," describes a matching type game in which only two players may play at a time. Players each play a single card, and compare the two. A second card is dealt to the player having the lower valued hand, with the hands being compared again. Play continues until the two hands tie or until one of the hands reaches a predetermined count, in which case the lower valued hand wins. The Miller game teaches away from the present game, in that (1) no wins are provided for a match of any cards, and (2) the game cannot be played by more than two players, making it unsuitable for casino play.

U.S. Pat. No. 5,566,946 issued on Oct. 22, 1996 to Alan G. Parker, titled "Method Of Playing A Card Game," describes a modification of a blackjack or twenty one game, in which a player may place two wagers. A conventional ante wager is placed initially, before the cards are dealt. However, players may place additional wagers during play, betting on the likelihood of the count of the players' hands exceeding the count of the dealer's single hand, without exceeding twenty-one. Different payouts are provided, depending upon the difference between the players' and dealer's hands. However, Parker does not provide any payout for any form of match, nor for specific mismatches of a single reference card and one of the cards in the hands, as is the case in the present card game.

U.S. Pat. No. 5,813,673 issued on Sep. 29, 1998 to Ronald Richardson, titled "Method Of Playing A Card Game," describes a wagering game in which a single reference card is dealt to the dealer with each player receiving two cards, all from the same deck. The object is for at least one of the player cards to be higher or lower than the single dealer card, as decided upon by the player before the cards are dealt. Richardson does not make any provision for exact matching of rank and suit between the dealer's and players' hands, as only a single card deck is used. Moreover, Richardson does not provide for wagering on the probability of a specific mismatch occurring, i.e., cards of the same rank and suit color but different suits, as is provided optionally in the present game.

U.S. Pat. No. 5,816,577 issued on Oct. 6, 1998 to Mark Preston et al., titled "Game Of Chance Matching Game And Method Therefor," describes a game in which each of the players are dealt three cards from one deck, with the dealer dealing a single reference card from a second deck. The object of the game is for players to match the rank or value of the single dealer card. The Preston et al. game differs from the present game in that (1) Preston et al. continue to provide for additional dealer cards, in the event that none of the player cards match during the first round; (2) Preston et al.

count any similarly valued cards of different suits as a match; he does not require the suits to match; (3) Preston et al. do not provide for any specific mismatches; and (4) Preston et al. provide an individual hand to each player, rather than dealing collective player hands.

U.S. Pat. No. 5,839,731 issued on Nov. 24, 1998 to John Feola, titled "Method And Apparatus For Playing A Casino Game," describes a game in which multiple hands are dealt by the dealer, with the dealer determining specifically which card game (e.g., poker, blackjack, etc.) is to be considered to determine the winning hand of the hands dealt. Players wager upon which of the plurality of hands will win, according to the specific game selected by the dealer. Feola does not provide for any matching of a single dealer reference card and another card from any of the hands dealt, nor does he provide for specific mismatches, as is possible with the present card game.

U.S. Pat. No. 5,895,047 issued on Apr. 20, 1999 to Paul E. Callahan, titled "Method For A Novel Card Game," describes a game in which only a single card is dealt to the dealer and to each player, with the high card winning. Ties result in a third card being dealt to the tied player. The Callahan game also provides for simultaneous wins by both the bank (dealer) and player, in the event that a third card is drawn and the third card has a lower rank than the two tied cards of the dealer and player hands. Simultaneous losses are provided if the third card is higher than the tied dealer and player cards. No explanation is provided in the Callahan disclosure, as to how both bank and player can win or lose simultaneously during play of a single card hand. Callahan complicates his game by providing for automatic wins or losses in the respective event that an ace or a two is drawn, unlike the present game.

U.S. Pat. No. 6,004,205 issued on Dec. 21, 1999 to Antonio Lauretta et al., titled "Match The Dealer," describes a game in which five cards are dealt to each of the players and to the dealer. The object of the game is for the players to match as many cards as possible between their hands and the dealer's hand. However, the card deck used is non-standard, having a single suit with five sets of ten cards each, from ace through ten. Lauretta et al. modify their wagering provision by allowing payouts for matching cards in a given player's hand, i.e., two, three, four, or five of a kind, unlike the present game. Moreover, Lauretta et al. cannot provide for specific mismatches, i.e., like ranking or value and suit color in different suits, since Lauretta et al. do not provide conventionally suited cards.

U.S. Pat. No. 6,164,652 issued on Dec. 26, 2000 to Antonio Lauretta et al., titled "Match The Dealer Card Game," is a divisional patent of the '205 U.S. patent to the same inventors, discussed immediately above. The same points raised in the discussion of the '205 U.S. patent are seen to apply here as well.

U.S. Pat. No. 6,234,483 issued on May 22, 2001 to Blair Bucan, titled "Method Of Playing A Matching Card Game," describes a game in which each player controls a single hand of three cards, with the dealer dealing one card at a time from a second deck. The object is for the player(s) to match the cards being turned up by the dealer, with the first player to match the various dealer cards with all three of the cards in his or her hand, winning. The Bucan game differs considerably from the present game, in that (1) each player is responsible for his or her own hand, rather than the dealer dealing a pair of hands for matching cards therein with the single reference card; (2) the Bucan game may prove relatively complex for players, as each player must constantly monitor all three of his or her cards as a series of cards is turned up by the dealer; (3) each hand of the Bucan game would likely extend for some period of time, as a relatively large number of dealer cards would have to be dealt in order for one of the players to achieve a match with all three of his or her cards, particularly if a relatively small number of players are playing; (4) Bucan does not provide any award or payout for a specific mismatch, i.e., cards of like value and suit color but in different suits, as provided by the present game; and (5) Bucan provides for only a single wager before the play of the hand, rather than allowing players to place an additional wager(s) optionally upon other potential outcomes.

U.S. Pat. No. 6,382,629 issued on May 7, 2002 to Clarence B. Hill, titled "Card Game," describes a keno-like game in which players do not receive cards, but rather receive scoresheets upon which they mark their anticipated winning numbers. A dealer deals a series of cards face down from a conventional deck (with two jokers) in nine stacks, each containing six cards. The dealer then turns up one card at a time from the stacks, working progressively through each stack. Players win depending upon the anticipated matches they previously marked upon their scoresheets, as in keno.

Finally, U.S. Pat. No. 6,402,149 issued on Jun. 11, 2002 to Henry H. Chou, titled "Method Of Playing A Magic Seven Card Game," describes a game using a non-standard deck of cards comprising four suits from ace through six, and two jokers. Each player is dealt two cards, with the object being to attain a hand which is higher, lower, or equal to seven, as predetermined by the players before the hand is dealt. The dealer does not receive any cards in the Chou game, but acts only as a dealer, dealing cards to the players and monitoring the game. Chou does not provide for any matching of cards or specific mismatching, as provided by the present card game.

None of the above inventions and patents, taken either singly or in combination, is seen to describe the instant invention as claimed. Thus a card game solving the aforementioned problems is desired.

SUMMARY OF THE INVENTION

The present card game comprises a relatively simple and fast paced game that is well suited for play as a wagering game in casinos and the like. The present game utilizes two decks of cards for each hand or round of play, with the dealer dealing two groups or sets of five cards each from one deck, face down, and a single face up reference card from the second deck. If they have not already done so, players place wagers upon the likelihood of an exact match occurring between one of the cards in the first set of five cards and the reference card from the second deck.

The present game allows players to place optional wagers as well upon the likelihood of the reference card matching one of the five cards of the second set, or being a specific mismatch to one of the cards in the first or second set, i.e., having the same rank or numerical value and suit color, but of a different suit.

Once the wagers have been placed, the dealer turns up one card at a time from the five cards of the first set to determine whether or not there are any exact matches or specific mismatches between one of those cards and the reference card. Payouts to winning players are made accordingly. Once the five cards of the first set have been turned up and wagers paid as appropriate, play continues with the dealer turning up the five cards of the second set to determine if there are any exact matches or specific mismatches between the second set and the reference card. Again, payouts are made accordingly to wagering players, if such matches or mismatches occur. Payout odds depend upon whether or not any match or mismatch occurs in the first or second set, and whether or not the player has wagered upon both a match and a mismatch in either or both sets. The present game may also include a specifically configured gaming table for play, if so desired.

Accordingly, it is a principal object of the invention to provide a wagering card game having simple rules allowing for rapid play, and also allowing players to place multiple wagers upon the likelihood of various outcomes during play.

It is another object of the invention to provide a wagering card game in which a dealer handles all cards, with the wagering players handling only their own wagering chips or markers, rather than handling any of the cards.

It is a further object of the invention to provide a wagering card game in which two groups or sets of five cards are dealt face down by the dealer from one deck, with the dealer then dealing a single reference card face up from a second deck. The cards from the two groups or sets are then turned face up in sequence and considered for an exact match to the single reference card, with payouts provided to successfully wagering players.

Still another object of the invention is to provide a wagering card game in which payouts are provided to successfully wagering players for any specific mismatch between one of the cards of the two sets of the first deck and the single reference card of the second deck, i.e., with the cards having the same rank or value and suit color, but being of different suits from one another.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a series of embodiments for a wagering type card game, in which wagers are placed upon the possibility of a single reference or "pull" card taken from one deck, exactly matching any of a series of cards randomly dealt from a second deck. More than one series of cards may be dealt to provide multiple wagering opportunities, and wagers may additionally be placed upon the likelihood of the single reference card being an "opposite match," i.e., matching the rank or value and suit color, but being of a different suit than one of the randomly drawn cards. The present game thus provides several alternative wager possibilities, yet is a clearly and easily understood game. This simplicity lends itself well to casino play, where rapid completion of each hand is desired.

Figure 1:
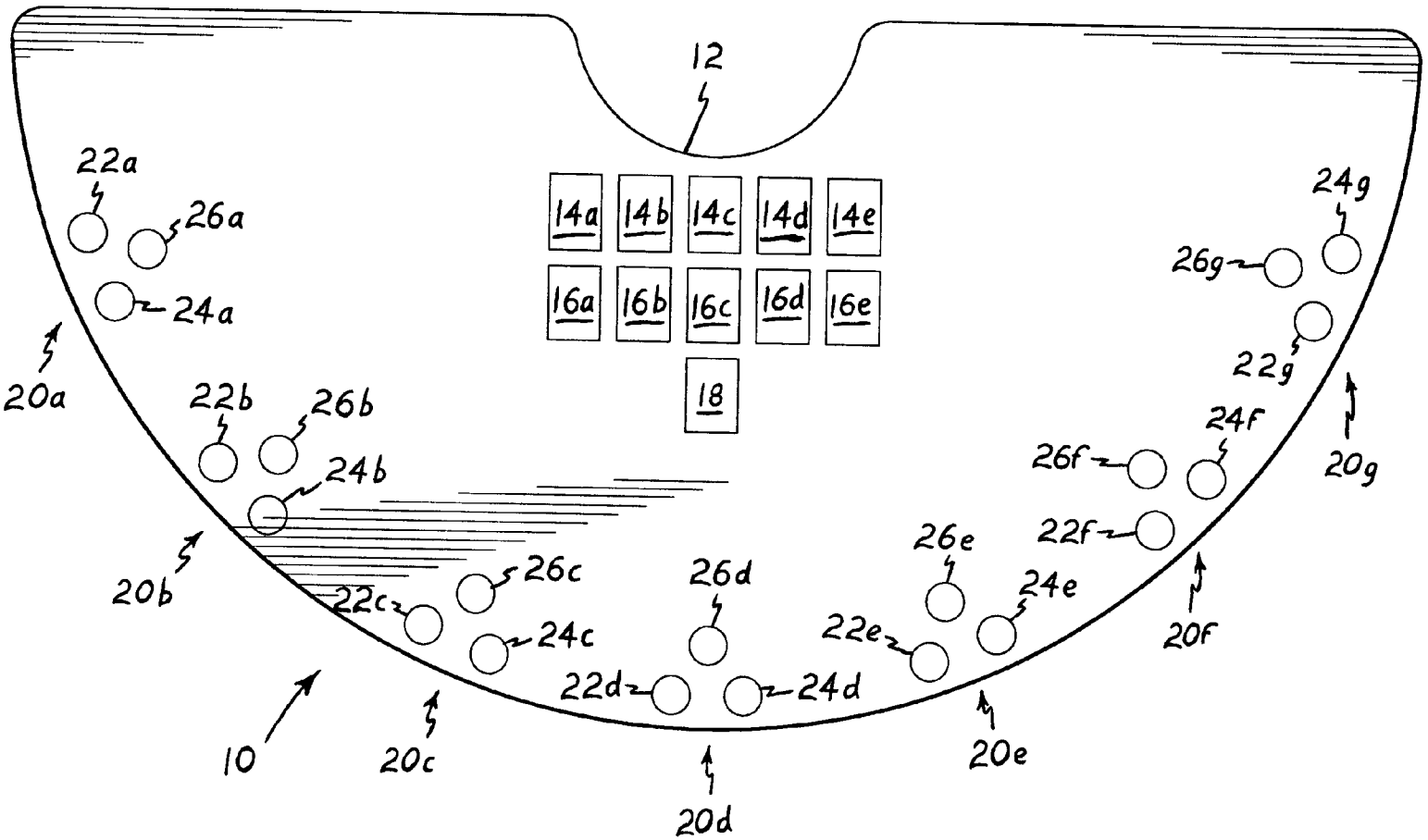
FIG. 1 is a top plan view of an exemplary gaming table for use with the wagering card game of the present invention.

FIG. 1 of the drawings provides a top plan view of an exemplary playing or gaming table 10 which may be used for play of the present game. It will be understood that the table 10 of FIG. 1 is exemplary, and that any of a multitude of different table configurations may be used for the play of the present game without substantially affecting the play of the game itself. The table 10 of FIG. 1 includes a dealer position or area 12, where a dealer, e.g. a casino employee or alternatively another party or agent, is conventionally situated. The dealer area 12 includes a series of first card group positions 14*a* through 14*e*, with another series of second card group positions 16*a* through 16*e* provided adjacent the first group positions 14*a* through 14*e*. Finally, a single reference or "pull" card position 18 is provided adjacent the first and second card group positions 14*a* through 14*e* and 16*a* through 16*e*. Preferably five card positions are provided in each of the first and second card group positions 14*a* through 14*e* and 16*a* through 16*e*. However, the number of card positions in each group may be adjusted as desired.

The table 10 further includes a plurality of player positions or areas, e.g., areas 20*a* through 20*g*, although more or fewer such positions may be provided as desired. Each of the player positions or areas 20*a* through 20*e* includes a position or spot (respectively 22*a* through 22*e*) for placing a wager on a first group or round match, a position or spot (respectively 24*a* through 24*e*) for placing a wager on a second group or round match, and a third position or spot (respectively 26*a* through 26*e*) for placing a wager on a specific mismatch in either round.

Figure 2:
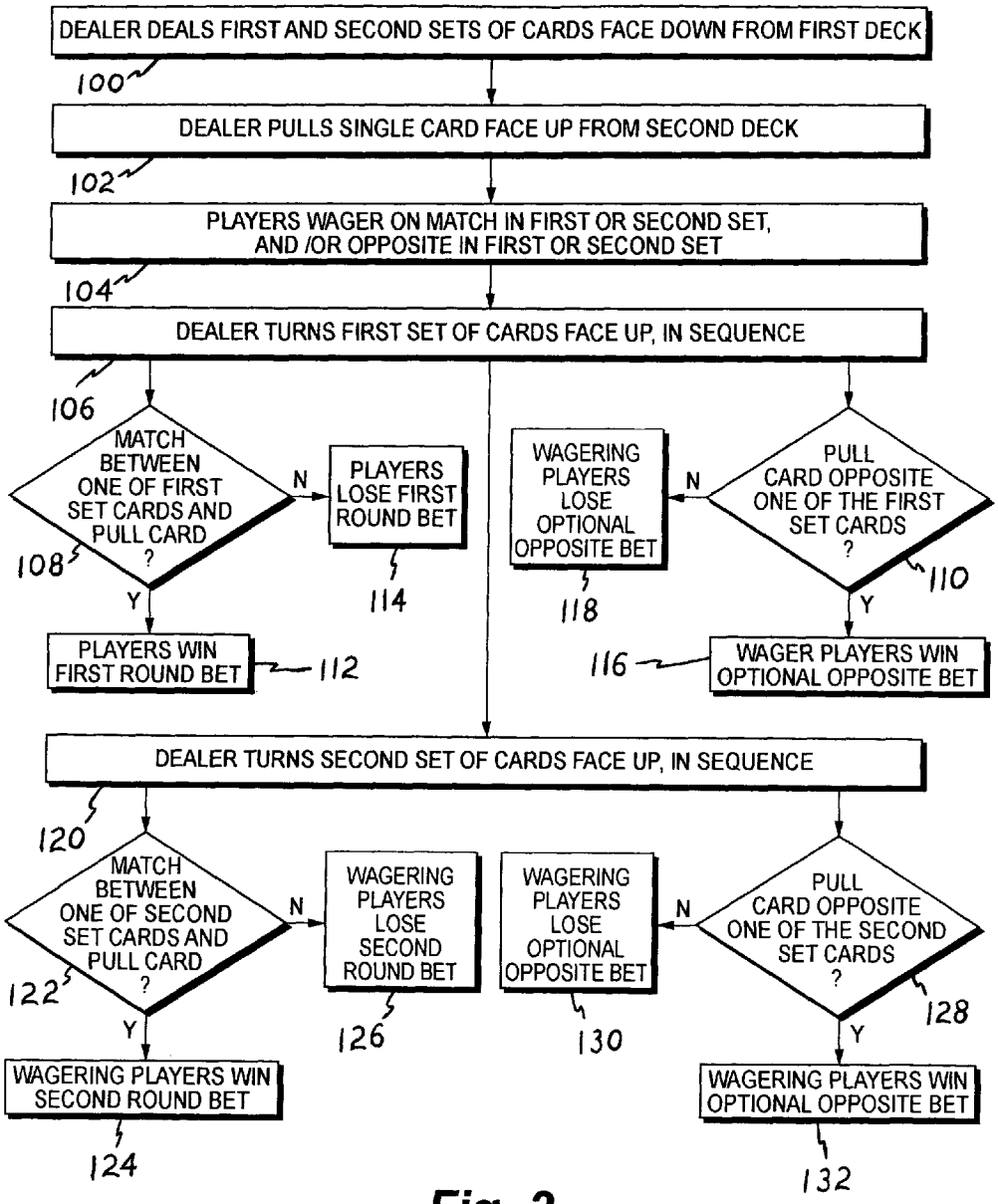
FIG. 2 is a flow chart illustrating the basic steps in the method of play of the present card game, and their relationships to one another.

FIG. 2 provides a flow chart illustrating the basic steps in the method of play of the present game. In a casino game, the dealer is conventionally an employee of the casino. In other games, the dealer may be selected or determined as desired. One or more players join in the game, as desired. The table 10 of FIG. 1 includes positions for seven players, but more or fewer may play, depending upon the specific table layout and other factors. At least two decks of conventional playing cards are used in the play of the present game. Each deck includes four suits (spades, hearts, diamonds, and clubs), with each suit having thirteen cards ranging from ace through ten and the jack, queen, and king of each suit.

Play is initiated by the dealer dealing a first series or group of cards face down from the first deck, followed by a second series or group face down from the same deck, generally as indicated in the first step 100 of FIG. 2. Preferably, five cards are dealt in each group or set, although more or fewer cards may be dealt in accordance with modifications to the rules. These cards may be placed upon the ten positions 14*a* through 14*e* and 16*a* through 16*e* shown on the table 10 of FIG. 1. The dealer then deals or "pulls" a single reference or "pull" card randomly from the second deck of cards, generally as indicated by the second step 102 of FIG. 2. This "pull" card is placed face up on the reference or pull card position 18 on the table 10 of FIG. 1, i.e., with the rank or value and suit of the pull card being exposed to view to all players and the dealer.

At this point, all players must place (or have placed) at least an initial wager (if they have not done so before the cards were dealt) upon the likelihood that the single reference or "pull" card will exactly match one of the first group cards by placing a wager upon the appropriate initial wager position 22*a* through 22*g* of the table 10, as indicated by the third step 104 of the FIG. 2 chart. In order for the players to win this wager, the "pull" card dealt from the second deck must match one of the cards of the first group from the first deck of cards, i.e., both the rank and the suit must match exactly. This is possible according to the rules of the present game, as at least two decks of identical conventional playing cards are used, with one deck being used to deal the cards of the first two groups or sets, and the second deck used to provide the reference or "pull" card.

In accordance with the third step 104 of FIG. 2, players also have the option of placing additional wagers, if they so choose. While the initial wager described above is mandatory for all participating players, players may also place an optional wager upon the likelihood of an exact match between the single "pull" card and any of the cards previously dealt face down in the second group or set of cards, i.e., those cards placed upon the positions 16*a* through 16*e* of the table 10 of FIG. 1. This optional second group or set wager is placed on the second group or set match wager position 24*a* through 24*g* of the table 10 of FIG. 1. The same rules apply as for a match between any card of the first group or set and the pull card, with an exact match of both rank and suit being required for a match.

The present game provides still other wager possibilities for players, by allowing players to place optional wagers upon the likelihood of one of the cards of the first or second group or set being an "opposite" to the reference or "pull" card, i.e., one of the cards of the first or second group having the same rank and suit color as the "pull" card, but of a different suit. Examples of such a specific mismatch are the three of hearts and three of diamonds; the jack of spades and the jack of clubs; the ace of clubs and ace of spades; etc. Only one card out of a conventional fifty-two card deck will be of such a specific mismatch to any given card from a second deck. Thus, the odds of such a specific mismatch occurring during the course of play of the present game are the same as those of an exact match occurring. Only a single "opposite" wagering position 26*a* through 26*g* is provided for each player position 20*a* through 20*g* on the table 10 of FIG. 1, as the optional "opposite" wager is carried over to the second group or set of cards in the event that it does not occur during the play of the first group.

Once all players have placed their wagers as required or desired, as indicated by the third step 104 of FIG. 2, the dealer turns up each of the first set or group cards in sequence, i.e. the cards placed upon the positions 14*a* through 14*e* of the table 10, generally as indicated by the fourth step 106 of FIG. 2, and compares the single reference or "pull" card with each card as it is turned up. The dealer and players are looking for one, or both, of two possibilities here: (1) that one of the cards of the first group will exactly match the reference or "pull" card in rank and suit, as indicated by the fifth step 108 of FIG. 2; and/or (2) that one of the first group cards will be an "opposite" to the pull card, i.e., matching in rank and suit color, but being of different suits to one another, as indicated by the sixth step 110 of FIG. 2.

If there is an exact match of rank and suit between one of the cards of the first group or set and the "pull" card, then all players win the first round or group wager, as indicated by the seventh step 112 of FIG. 2. The payout may be determined in accordance with the casino and/or other governing or ruling body, as desired. It has been found that payout odds of three to two to the players works well, as it must be kept in mind that all players are required to place the initial wager in order to participate, and thus all players will win if a match occurs in the first round of play. This is not necessarily so for other rounds and wagers, where additional wagers are optional, with non-betting players not receiving any award in the event of a match or specific mismatch. Where no exact match is achieved, players lose their first round wager, as indicated by the eighth step 114 of FIG. 2. Clearly, no match is possible in the second group of cards when a match has been made in the first group, since both groups are dealt from the same deck and only one card from the deck can exactly match the single reference or "pull" card from the second deck. Where players have placed an optional wager upon a match in the second group of cards, and a match is made in the first group, the optional second group wager is a "push," and all wagers are returned to the betting players.

Players who have placed an optional "opposite" wager upon the appropriate location 26*a* through 26*g* on the table 10, are wagering that one of the cards of the first or second group or set will be a specific mismatch to the reference or "pull" card, i.e., matching in rank and suit color but being of a different suit, as explained further above. As such an "opposite" card is of a different suit than a matching card (if such occurs) in the two groups or sets dealt from the first deck, it will be seen that it is entirely possible for both an exact match and a specific mismatch or "opposite" to occur in a single hand or round of play. Where players have placed such an optional "opposite" wager and such an "opposite" or specific mismatch occurs, players win their optional "opposite" wager, as indicated by the ninth step 116 of FIG. 2. As in the case of an exact match win, the payout may be set or adjusted in accordance with governing rules for the game, but the same payout odds used for an exact match in the first group or round, i.e. three to two, may be used when an "opposite" match occurs.

Players placing optional "opposite" wagers will of course not win anything where no such "opposite" card is turned up. This is indicated by the tenth step 118 of FIG. 2, indicating that such players lose their optional "opposite" wager. This is true in the sense that they cannot win anything under these circumstances, but it is more correct to say that such an optional "opposite" wager carries over to the second round of play, in which the second set or group of cards is turned up in sequence.

The eleventh step 120 of FIG. 2 indicates the initiation of the second round of play in a hand of the present card game. To begin the second round, the dealer turns up each of the cards of the second set, i.e., the cards initially placed upon positions 16*a* through 16*e* of the table 10 of FIG. 1. Play continues generally as described further above for play during the first round, with the exception that all wagering is optional in the second round, and thus there may be players from the first round who do not participate in second round play. Participating players again place a wager on the possibility of an exact match between the single reference or "pull" card and one of the series of cards of the second group or set.

Those players who have previously placed a wager upon the possibility of an "opposite" card mismatch in the first round will have their wagers carry over to the second round, where such a mismatch is still possible in the second round. Again, it will be possible to achieve only a single exact match, and/or a single opposite card mismatch, in any given hand comprising two groups or sets of cards from a single deck. Thus, if an exact match has occurred in the first round, then any second round wagers on such an exact match will be returned to the wagering players, as noted further above. However, second round play continues with the second group of cards to determine if a specific mismatch or "opposite" card turns up, if such has not occurred in the first group or set of cards. Again, wagers made on such a possibility at the beginning of the first round, carry over to the second round where no such mismatch has occurred in the first round.

The series of cards of the second group or set are turned face up in sequence and compared to the single reference or "pull" card, as indicated generally by the twelfth step 122 of FIG. 2 and similarly to the procedure used in play of the first round or set of cards as described further above. Where a player has placed a wager upon the likelihood of a second round match, and no such match occurred in the first round, then the wagering player(s) win(s) the wager(s), as indicated by the thirteenth step 124 of FIG. 2. As in the case of other wager payouts, the odds may be adjusted as desired in accordance with casino or other governing body rules and regulations. A payout of two to one provides an acceptable incentive, but the odds may be adjusted between the first and second rounds of play to provide a higher payout for a win in the first round, if so desired. If no match occurs in the second round, then any player(s) placing such an optional second round wager will lose their wagers, as indicated by the fourteenth step 126 of FIG. 2.

A final possibility is that the second group or set of cards, i.e. the cards placed upon the positions 16*a* through 16*e* of the table 10, contains an "opposite" card to the single "pull" card, generally as indicated by the fifteenth step 128 of FIG. 2. As these cards are turned face up in sequence, the dealer will be looking for such a specific mismatch card, as well as a precise match card as described above. If such a specific mismatch or "opposite" card to the reference or "pull" card is turned up, then any player(s) placing an optional wager on this possibility, will win their wager(s), as indicated by the sixteenth step 130 of FIG. 2. As in the other cases described further above, the payout odds may be adjusted as desired in accordance with applicable rules and regulations. A payout of two to one may be provided for consistency in second round play, but these odds may be adjusted to provide a lesser payout than winning payouts in the first round, if so desired.

If no specific mismatch or "opposite" card appears in the second round of cards, then any player(s) having placed a wager(s) upon the single "opposite" wager position(s) 26*a* through 26*g* of the table 10 will lose their wager(s), as indicated by the seventeenth step 132 of FIG. 2. Only the single "opposite" wager position is provided for each player to place a wager upon this possibility in either of the two groups or sets of cards played in each hand or round. Thus, if no "opposite" card is turned up in the first group or set of cards, any optional "opposite" wager made by any player(s), carries over to the second group or set of cards, as noted further above. A player wagering upon the possibility of such an "opposite" card being turned up, thus has two opportunities to win such a wager due to the two groups or sets of cards played in the present game.

In conclusion, the present card game provides a game which is easily understood by both novice and experienced players, and which provides rapid play and turnover without confusing novice players. Casinos will thus find the present game to be a desirable addition to the various games and activities offered, due to the rapid play of each hand and resulting number of wagers which may be placed during a given period of play. Yet the present game will also prove attractive to players of all experience levels, due to the simplicity of the rules and the opportunity to win multiple wagers in any given hand or round of play.

It is to be understood that the present invention is not limited to the embodiments described above, but encompasses any and all embodiments within the scope of the following claims.

I claim:

1. A method of playing a card game, comprising the steps of:

(a) providing a dealer, at least one player, and at least a first deck and a second deck of conventional playing cards;

(b) dealing at least a first group of cards, face down, from the first deck, and a reference card, face up, from the second deck, the cards being dealt by the dealer;

(c) placing a wager by each player upon at least the likelihood of an exact rank and suit match between one of the cards of the first group, and the reference card;

(d) turning up each of the cards of the first group in sequence, by the dealer;

(e) comparing the reference card with each of the cards of the first group as they are turned up; and (f) providing a payout to all players, when an exact rank and suit match occurs between the reference card and any of the cards of the first group.

2. The method of playing a card game according to claim 1, further including the steps of:

(a) placing an optional wager by each participating player upon the likelihood of an exact rank and identically colored but different suit match between the reference card and one of the cards of the first group; and (b) providing a payout to any such wagering players, when an exact rank and identically colored but different suit match occurs between the reference card and one of the cards of the first group.

3. The method of playing a card game according to claim 2, further including the step of providing a payout of three to two for an exact rank and identically colored but different suit match between the reference card and one of the cards of the first group.

4. The method of playing a card game according to claim 1, further including the step of providing a payout of three to two for an exact rank and suit match between the reference card and one of the cards of the first group.

5. The method of playing a card game according to claim 1, further wherein step (b) comprises dealing five cards in the first group of cards.

6. The method of playing a card game according to claim 1, further including the steps of:

(a) dealing a second group of cards, face down, from the first deck, by the dealer, after step (b);

(b) placing an optional wager by each participating player upon the likelihood of an exact rank and suit match between the reference card and one of the cards of the second group;

(c) turning up each of the cards of the second group in sequence, by the dealer;

(d) comparing the reference card with each of the cards of the second group as they are turned up; and (f) providing a payout to any such wagering players, when an exact rank and suit match occurs between the reference card and any of the cards of the second group.

7. The method of playing a card game according to claim 6, further including the steps of:

(a) placing an optional wager by each participating player upon the likelihood of an exact rank and identically colored but different suit match between the reference card and one of the cards of the second group; and (b) providing a payout to any such wagering players, when an exact rank and identically colored but different suit match occurs between the reference card and any of the cards of the second group.

8. The method of playing a card game according to claim 7, further including the step of providing a payout of two to one for an exact rank and identically colored but different suit match between the reference card and one of the cards of the second group.

9. The method of playing a card game according to claim 6, further including the step of providing a payout of two to one for an exact rank and suit match between the reference card and one of the cards of the second group.

10. The method of playing a card game according to claim 6, wherein the step of dealing a second group of cards comprises dealing five cards in the second group of cards.

11. The method of playing a card game according to claim 1, further including the steps of:

(a) providing a game table for the present card game;

(b) further providing a dealer area having a plurality of card positions for a first group of cards, a plurality of positions for a second group of cards, and a single reference card position; and (c) further providing a plurality of player areas, each having a first card group match wager position, a second card group wager position, and a specific mismatch wager position.

12. The method of playing a card game according to claim 11, further including the step of providing five card positions for each of the first group of cards and the second group of cards.

13. A gaming table for a card game, comprising a table having:

a single dealer position disposed thereon;

a first card group area adjacent said single dealer position, and having a plurality of card positions thereon;

a second card group area adjacent said single dealer position, and having a plurality of card positions thereon;

a single reference card group area adjacent said single dealer position;

a plurality of player positions disposed thereon;

a first card group match wager position at each of said player positions;

a second card group match wager position at each of said player positions; and a specific mismatch wager position at each of said player positions.

14. The gaming table according to claim 13, further including:

five card positions in said first card group area; and five card positions in said second card group area.

* * * * *